United States Patent [19]

Iavarone et al.

[11] 4,093,009

[45] June 6, 1978

[54] VACUUM PACKING DEVICE

[76] Inventors: Anthony Iavarone; Richard Anthony Iavarone, both of 20-61 St. Raymond Ave., Bronx, N.Y. 10462

[21] Appl. No.: 774,465

[22] Filed: Mar. 4, 1977

[51] Int. Cl.[2] ..... B65D 81/20

[52] U.S. Cl. ..... 150/.5; 99/472

[58] Field of Search ..... 99/472; 150/.5, 51; 426/124; 285/39, 192

[56] References Cited

U.S. PATENT DOCUMENTS

| | | | |
|---|---|---|---|
| 578,410 | 3/1897 | Lord | 99/472 |
| 722,408 | 3/1903 | Lane | 150/51 |
| 1,631,885 | 6/1927 | Peebles | 99/472 |
| 1,885,042 | 10/1932 | Baldwin | 285/192 X |
| 2,116,813 | 5/1938 | Weisser | 99/472 |
| 2,787,397 | 4/1957 | Radford | 150/.5 X |
| 2,828,789 | 4/1958 | Groendyk | 150/.5 |
| 2,859,786 | 11/1958 | Tupper | 150/.5 |
| 3,905,410 | 9/1975 | Arato | 150/1 |

FOREIGN PATENT DOCUMENTS

| | | | |
|---|---|---|---|
| 206,600 | 2/1909 | Germany | 99/472 |

*Primary Examiner*—Donald F. Norton
*Attorney, Agent, or Firm*—Robert D. Farkas

[57] ABSTRACT

A vacuum packing device for use with a resilient flexible container which has a resealable cover. A valve is releasably connectable to the cover through an aperture therein and is selectively openable and closable when the cover is engaged to permit withdrawal of air from the container and to prevent air from entering the container. A wire cage support is insertable in the container before engaging the cover to prevent the collapse of the container when air is withdrawn therefrom.

5 Claims, 4 Drawing Figures

VACUUM PACKING DEVICE

BACKGROUND OF THE INVENTION

The present invention relates to a vacuum packing device.

Vacuum packing devices are known in the prior art, but these devices are not adaptable for use with containers, such as Tupperware containers, since they have the disadvantage of collapsing the flexible container when air is withdrawn.

Among the known devices which has this disadvantage are those taught in U.S. Pat. Nos. 1,396,303,014, 477,805, 578,410, 817,208, 1,572,190, 1,621,132 and 1,631,885.

SUMMARY OF THE INVENTION

It is the principal object of this invention to provide a vacuum packing device for use with a flexible container.

This and other objects are achieved by the preferred embodiment of the invention in which a valve assembly is inserted through an aperture in the container cover. The assembly comprises a stem having a throughbore and a valve member disposed between the ends of the stem and outside of the closed container. A vacuum apparatus draws the air from the container through the throughbore in the stem and the opened valve member. The valve is then rotated closed to prevent air from entering the container. The valve member is clamped to the cover between a fixed mounting member on the valve member and a locking nut with the valve stem projecting through the aperture in the cover.

To prevent the plastic container from collapsing a steel wire cage is inserted in the container.

Having in mind the above and other objects that will be obvious from an understanding of the disclosure, the present invention comprises a combination and arrangement of parts illustrated in the presently preferred embodiments of the invention which are hereinafter set forth in sufficient detail to enable those persons skilled in the art to clearly understand the function, operation, construction and advantages of it when read in conjunction with the accompanying drawings.

BRIEF DESCRIPTION OF THE DRAWING

The invention will be described in detail, by way of example, with reference to the accompanying drawing in which.

DETAILED DESCRIPTION OF THE INVENTION

Figure 1:
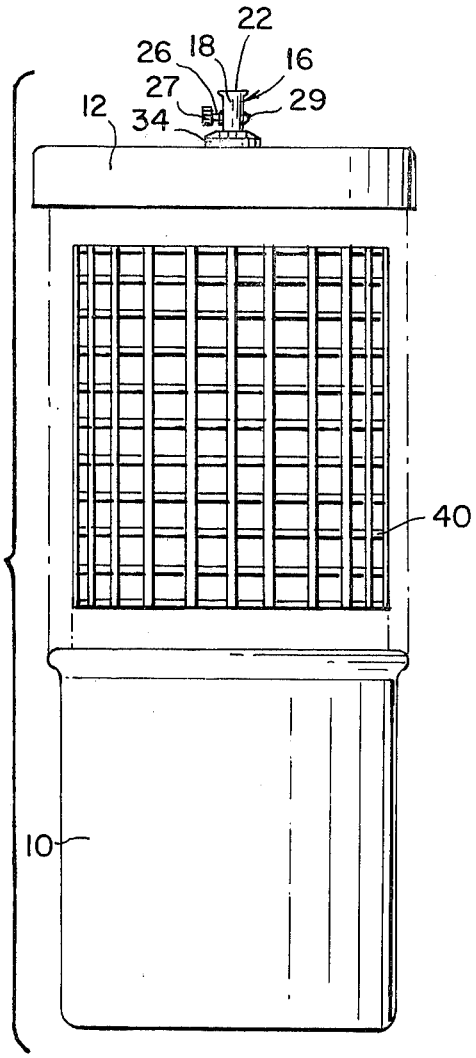
FIG. 1 is an exploded view of the preferred embodiment showing the principles of the invention.
Figure 2:
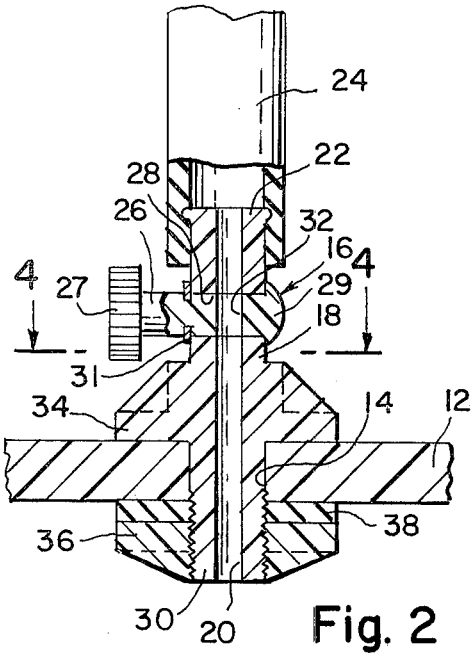
FIG. 2 is an enlarged partial section of the valve assembly.
Figure 3:
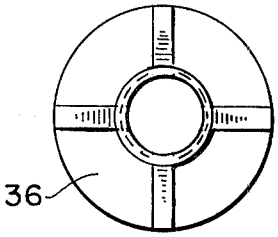
FIG. 3 is a plan view of the ribbed locking nut.
Figure 4:
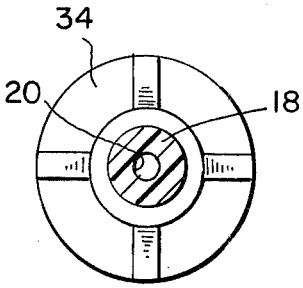
FIG. 4 is a sectional view taken along line 4—4 in FIG. 2.

Referring to FIGS. 1–4 of the drawing and in accordance with the principles of the invention, a vacuum packing device for use with a resiliently flexible container 10 and cover 12 is shown. The cover 12 is releasably engageable with the top of the container 10 to provide an air-tight seal therebetween and further includes a valve aperture 14 therein. A valve assembly 16 is inserted through the aperture 14 and is releasably connectable thereto.

The valve assembly 16 comprises an elongated valve stem 18 having a central throughbore 20. A first end portion 22 or upper end is configured to accept a hose 24 that is connected to a vacuum apparatus, not shown. A valve member 26 having a knob 27 affixed at one end is disposed adjacent to the upper and 22 pivotally mounted in a cross bore 28 perpendicular to the throughbore 20. A second portion 30 or bottom end is threaded for releasably engagement with the cover 12.

A valve port 32 disposed in the valve member 26 retained by a head portion 29 of the member 26 and a locking ring 31 around the stem 18 and perpendicular to the axis thereof is positioned to aligned with the throughbore 20 and is manually operable to permit the selective opening and closing of the passageway between the vacuum apparatus and the container 10 for selectively allowing or precluding fluid communication therebetween.

The valve stem 18 is releasably connected to the cover 12 by means of a ribbed mounting member 34 disposed between the valve member 26 and bottom end 30 and affixed to the stem 18 and is preferably integral therewith. The bottom end 30 is received through the valve aperture 14 in the cover 12 and is clamped in place with a ribbed threaded locking nut 36 engageable with the threads on the bottom end 30 of the stem 18 both the mounting member 34 and locking nut 36 are ribbed for structural strength and to provide a gripping portion for tightening and loosening the nut 36. A rubber gasket 38 is installed over the stem 18 and between the locking nut 36 and the bottom surface of the cover 12 to effect an air-tight seal between the stem 18 and cover 12.

To support the container 10 against collapse after it has been evacuated, a wire cage 40 configured to be closely received within the container is inserted therein prior to engaging the cover 12.

In use, foodstuff is put into the container 10 after the wire cage 40 has been placed therein. The cover 12 including the valve assembly 16 is placed over the container 10 and a vacuum device having hose 24 is connected to the upper end 22 of the stem 18. The valve member 26 is rotated to the open position, the container 10 is evacuated and the valve member 26 then rotated to the closed position. The hose 24 is removed from the stem 18 and the foodstuff is vacuum packed.

While the preferred embodiment of the invention is illustrated and/or described, it will be understood that the invention is in no way limited to this embodiment.

What we claim is:

1. A vacuum packing device comprising a resiliently flexible container, a resilient cover, said cover having a valve aperture therein, said cover being releaseably engageable with the top of said container, valve means connectable to said cover through said valve aperture and selectively openable and closable when said cover is engaged to said container permitting the withdrawal of air from said container and to therefor prevent air from entering said container support means insertable in said container before engagement of said cover to prevent the collapse of said container when air is withdrawn therefrom, said valve means including cover grasping means for grasping opposed lateral surfaces of said cover and providing a pair of pluralities of ribbed-like protrusions extending outwardly from each of said opposed lateral surfaces for manually releaseably securing said valve means to said cover.

2. A device according to claim 1, wherein said support means comprises a wire cage.

3. The apparatus as claimed in claim 1 wherein said pair of pluralities of protrusions extend further outwardly from said opposed surfaces at one end of each of said protrusions disposed adjacent said aperture than the other end of said protrusions, said other end of said protrusions disposed radially outwardly from said aperture.

4. A device according to claim 1, wherein said valve means comprises an elongated valve stem having a central throughbore, means disposed on a first end portion for effecting the connecting thereof to a vacuum apparatus and a threaded second end portion, a valve member disposed adjacent said first end portion, said valve member being manually operable to open and close said throughbore, said cover grasping means including a mounting member disposed around said valve stem between said valve member and said second end portion of said valve stem and a locking nut threadably engageable with said second end portion of said valve stem for mounting said cover between said mounting member and said locking nut with said valve stem through said valve aperture in said cover, said mounting member carrying one of said pair of pluralities of protrusions, said locking nut carrying the other of said pair of pluralities of protrusions.

5. The apparatus as claimed in claim 4 further comprising a rubber-like gasket removeably disposed between one of said pair of opposed surfaces and said locking nut.

* * * * *